United States Patent [19]

Pingel

[11] Patent Number: 4,658,527

[45] Date of Patent: Apr. 21, 1987

[54] SIGN HOLDERS

[76] Inventor: Matthias A. Pingel, 9837 Tesson Ferry Rd., St. Louis, Mo. 63123

[21] Appl. No.: 792,287

[22] Filed: Oct. 28, 1985

[51] Int. Cl.[4] ..... G09F 15/00

[52] U.S. Cl. ..... 40/606; 40/617; 40/493

[58] Field of Search ..... 40/584, 617, 606, 607, 40/605, 377

[56] References Cited

U.S. PATENT DOCUMENTS

| | | | |
|---|---|---|---|
| 735,964 | 8/1903 | Coleman et al. | 40/617 |
| 1,417,519 | 5/1922 | Hannah | 40/584 |
| 1,569,424 | 1/1926 | Jacobus | 40/584 |
| 1,649,249 | 11/1927 | Newman | 40/607 |
| 1,824,578 | 9/1931 | Thake | 40/607 |
| 2,454,648 | 11/1948 | Green | 40/602 |
| 4,334,374 | 6/1982 | Spamer | 40/606 |
| 4,357,772 | 11/1982 | Amick et al. | 40/606 |
| 4,435,584 | 6/1985 | Howard | 40/606 |
| 4,559,133 | 12/1985 | Forslun | 40/605 |

*Primary Examiner*—Gene Mancene
*Assistant Examiner*—Wenceslao J. Contreras
*Attorney, Agent, or Firm*—Haverstock, Garrett & Roberts

[57] ABSTRACT

A sign holder comprising a panel including spaced front and rear panel members, at least one of the panel members being adapted to receive indicia thereon for display purposes, and a plurality of vertically spaced, transverse extending web members connected between the front and rear panel members. The web members with adjacent portions of the front and rear panel members define a plurality of vertically spaced, transversely extending channels. To support the panel in a vertical position, a pair of support elements are provided, one of the support elements on each transverse side of the panel. To suspend the panel from the support elements, a pair of pin members are provided, each pin member having one end removably connected to respective ones of the support elements and an opposite end removably received in at least one of the channels of the panel.

15 Claims, 9 Drawing Figures

SIGN HOLDERS

This invention relates to signs and more particularly to sign holders that are convenient to assemble, erect, disassemble and store and that support a sign such that the sign is free to swing with the wind. Still more particularly, this invention relates to a sign holder comprising a pair of vertical support elements supporting an indicia bearing sign panel, the support elements being adapted to be imprecisely positioned on opposite sides of the sign panel. Connector means are provided that removably connect the panel to each of the vertical support elements which permit variable transverse and vertical positions on the sign panel relative to and between each of the vertical support elements.

BACKGROUND OF THE INVENTION

Heretofore various types of temporary, collapsible or knock-down signs and sign holders have been suggested for use in advertising, road construction or the like that are intended to provide ease in assembly and disassembly or intended for use on a temporary basis. Examples of such prior art devices are disclosed in U.S. Pat. Nos. 1,429,211 to Lightburn, 2,814,140 to Ellis, 2,872,750 to Holcomb, 3,469,335 to Leigh and 3,616,557 to Vara. However, such prior art devices while suitable in some respects have not always been as economical in the construction or stable in use as one might desire. Additionally, such devices were not always as convenient to store, assembly, erect, disassemble and transport as is sometimes necessary or desirable. This is particularly true in certain temporary sign applications wherein sign installation and removal is intended to be performed by a person not equipped for, or skilled in the art of sign erection, as for temporary signs for political campaigns or for temporary real estate applications. In real estate, for example, a real estate agent of either sex, dressed in normally restricted business clothes, without tools, is expected to store in the trunk of his or her passenger automobile, a number of such signs such as "House For Sale", "Sold", directions to a property location, and the like. In such circumstances, it is desirable that such signs and sign holders be light, compact and easy to store and transport, preferably with interchangeable parts to minimize storage requirements. Additionally, it is important that such signs and sign holders be non-complicated and convenient for anyone to assemble and disassemble without tools and without precise relative placement of the elements thereof. It is likewise important that such signs be erectible and removable from a temporary erection site without expenditure of substantial physical effort, without substantial physical dexterity and without significant physical disturbance to the site environment.

The present sign holder invention overcomes the disadvantages and shortcomings associated with the known prior art sign holders and teaches a particularly simple sign holder comprising a weather resistant vertical panel formed of spaced front and rear panel members, one or both of which being adapted to receive indicia thereon for display purposes, and a plurality of vertically spaced, transversely extending web members connected between the front and rear panel members. The plurality of vertically spaced web members together with adjacent surfaces of said front and rear panel members define a plurality of vertically spaced, transversely extending channels. To support the vertical panel on a supporting surface, a pair of vertical support rods are provided, one of said support rods being positioned on each transverse side of the vertical panel. To suspend the panel from the support rods, a pair of elongated slip pins are provided, each pin having an outer end removably connected, as by a bolt and wing-nut to one of said vertical support rods and an inner free end slidably and removably received to a greater or lesser extent in a selected one of the channels of the vertical panel board.

To erect a sign in an outdoor environment utilizing a sign holder according to the present invention, it is merely necessary to insert the support rods into a supporting surface such as a lawn. Because the rods are relatively slender, little physical force is required and little noticeable disturbance to the lawn is caused by erection or removal. The rods are spaced apart a distance at least as great as the width of whatever size sign panel board is to be erected but this distance need not be precise because of Applicant's inventive slip pin connector concept. In this regard, the positioning of the sign panel board right or left or up or down relative to each of the support rods need not be precise for the same reason. The slip pins are merely slidably received to a greater or lesser extent in an appropriate one, up or down, of the tranversely extending channels in the panel of the present invention and the outer ends of the slip pins connected to the support rods. Any requirement for exact positioning of the support rods relative to each other or the panel relative to each support rod is avoided, thereby simplifying erection procedure to a substantial extent and providing a degree of flexibility and interchangeability of parts not heretofore available.

It is therefore an object of the present invention to provide a sign holder which is easy to assembly and erect without requiring precise relative positioning of the elements thereof.

It is another object of this invention to provide a sign holder that is simple and convenient to assemble, erect and disassemble without tools and without the use of substantial physical force or dexterity.

It is another object of this invention to provide a sign holder that is neat in appearance and economical in construction.

It is still further an object of this invention to provide a sign and sign holder which is lightweight, compact and easy to store and transport.

It is another object of this invention to provide a sign and sign holder permitting variable distances between the vertical support elements of the sign holder and variable distances between each of the vertical support elements and the sign panel.

It is another object of this invention to provide a sign holder including vertical support elements and slip pin connector elements adapted for use with a plurality of different size sign panel of various lengths and widths.

It is another object of this invention to provide a sign and sign holder that is adapted for use outdoors, is stable in the wind and resistant to weather damage.

It is another object of this invention to provide a sign holder for outdoor use that may be erected and removed without noticeable disturbance of the erection site.

It is another object of this invention to provide a sign holder design that may be used alternately indoors or outdoors and with large signs or small ones.

Another object is to provide a sign holder that can have a message on both opposite sides.

Another object is to provide a sign panel of simple corrugated construction.

Another object is to provide a sign panel that is hingedly supported so that it may swing in the wind to a position so that minimum wind force is applied thereto.

Another object is to increase the visibility of signs by making them visible from both directions.

Another object is to make it possible to support sign panels in vertical orientation even on uneven ground.

These and other objects and advantages of the present invention will become apparent after considering the following detailed specification of one embodiment of the subject invention in conjunction with the accompanying drawings wherein:

DESCRIPTION OF THE DRAWINGS

FIG. 2(*a*) is a partial side view of an alternate form of a sign panel according to the present invention;

DESCRIPTION OF THE PREFERRED EMBODIMENT

Figure 1:
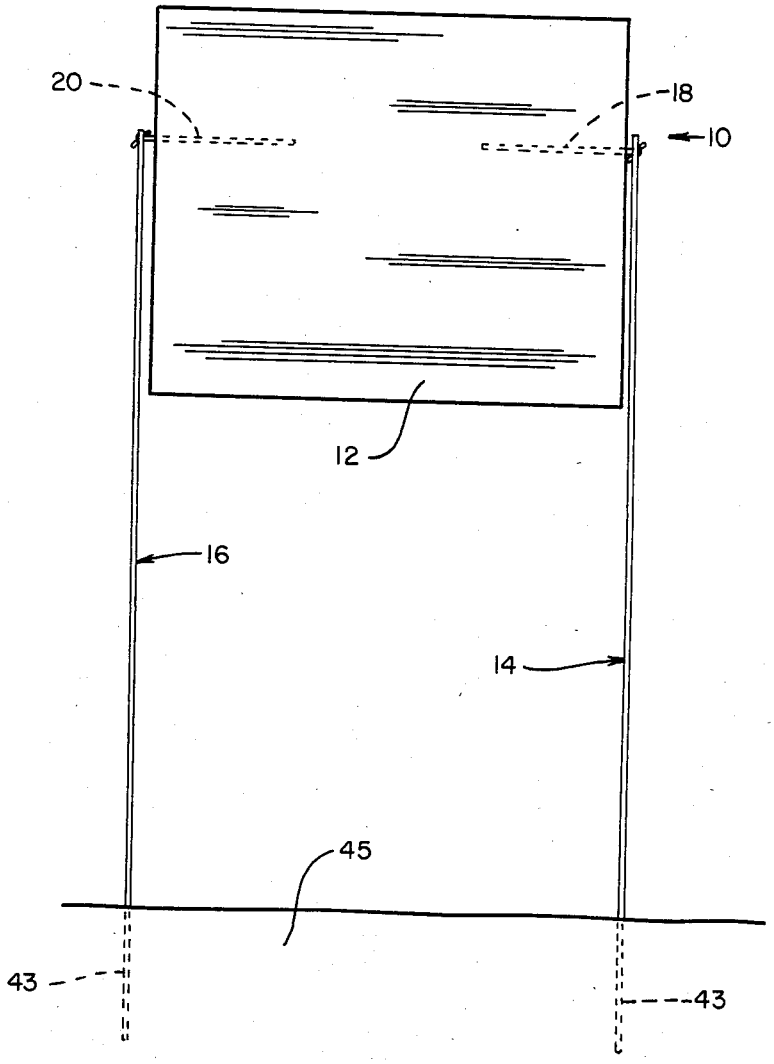
FIG. 1 is a front elevational view of a sign holder according to the present invention showing a sign panel board supported on vertical support elements erected in an outdoor environment.

Referring to the drawings in more detail by reference numbers wherein like numerals refer to like parts, a sign holder device 10 according to the present invention is shown in FIG. 1. The device 10 basically comprises a vertical sign panel or board 12 supported on right and left vertical support members or rods 14 and 16, respectively, by a pair of identical, right and left wire-like slip pin connectors 18 and 20.

Figure 2A:
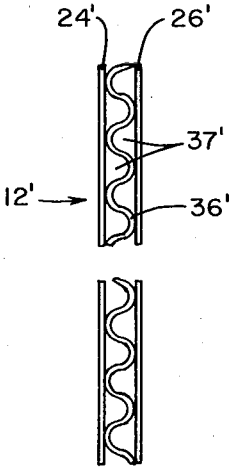
FIG. 2 is a side view of the sign panel shown in FIG. 1.
Figure 2:
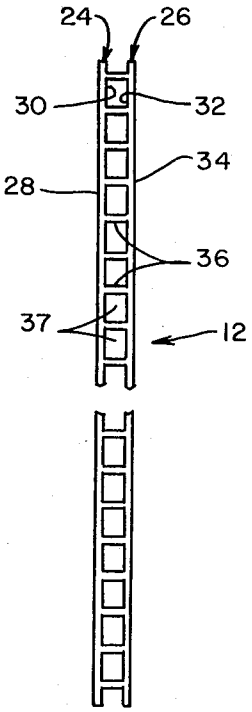

With reference to FIGS. 1 and 2 of the drawings, the sign panel 12 comprises front and rear panel members 24 and 26 respectively, each having front and rear face surfaces 28, 30, 32 and 34. In the preferred embodiment of this invention, the panel 12 is constructed of extruded, plastic, corrugated sheet material such as Coroplast ® although other sheet or board materials, or the like, such as shown in FIG. 2(*a*), may be utilized as long as such provide the requisite strength and weather resistance appropriate for the environment in which it is used. Referring to FIG. 2, the rear face surface 30 of the front panel member 24 is connected to the front face surface 32 of the rear panel member 26 by a plurality of integrally formed, vertically spaced transversely extending web members 36 which members along with adjacent portions of the rear and front face surfaces 30 and 32, form a plurality of vertically spaced, transversely extending, rectangular-shaped channels 37. The front face surface 28 of the front panel member 24 and the rear face surface 34 of the rear panel member 26 are preferably both weather resistant, smooth in texture, and adapted to receive indicia, as by silk screening, for display purposes. Alternately a sign of sheet material bearing such indicia may be affixed to the face surfaces 28 and 34 by any suitable adhesive means or other connector means. The sign panel board material is commercially available in different dimensions to form sign panel boards of different lengths, widths, and thicknesses. In a typical embodiment of the present invention, the panel board 12 is 24 inches high and 30 inches wide with a thickness of approximately 3/16 inch.

In an alternate form of the present invention shown in FIG. 2(*a*), the plastic panel 12 of the preferred embodiment, may be replaced for some applications by panel 12' constructed of corrugated cardboard. In this embodiment, the cardboard panel 12' comprises front and rear panel members 24' and 26' constructed of pressed cardboard, each adapted to receive indicia thereon. The members 24' and 26' are fixedly connected together by a sinuous, corrugated cardboard member 36' to form a plurality of channels 37'. If desired, the panel 12' may be coated with a weather resistant coating of any suitable type.

Figure 3:
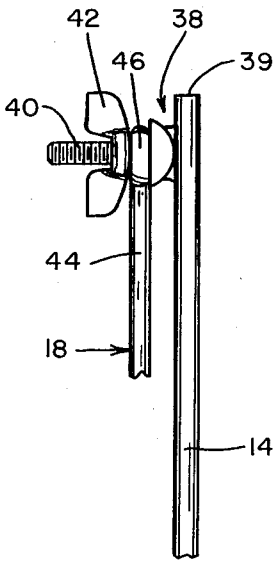
FIG. 3 is a fragmentary side view of the upper end of one of the vertical support elements shown in FIG. 1.

In a typical embodiment, the vertical support rods 14 and 16 which are identical, are formed of cold rolled steel rod 3/16 inch or larger in diameter and are approximately 48 inches in length but it is of course obvious that other diameter and length rods may be provided. Spaced from the upper end 39 of each vertical support rod 14, 16 a threaded member such as bolt 38, as shown in FIG. 3, is fixed in a perpendicular relationship to the rods 14 and 16, as by welding or the like. The threaded member or bolt 38 is provided with threads 40 on the free end thereof to receive a threaded wing-nut 42 or the like. The lower end 43 of the support rods 14 and 16 are adapted to be inserted in a supporting surface 45, such as into the ground or other support means, as will be hereinafter discussed.

Figure 4:
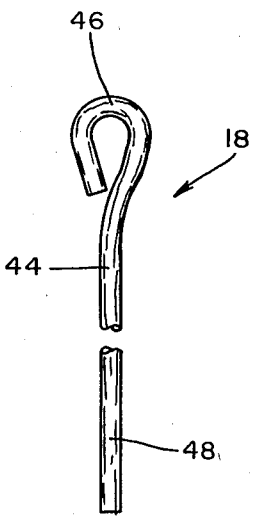
FIG. 4 is a fragmentary front view of a slip pin connector element for suspending the sign panel shown in FIGS. 2 and 2(*a*) on the vertical support element shown in FIG. 3.

To suspend or support the vertical sign panel 12 on the vertical support rods 14 and 16 a pair of slip pin connectors 18 are provided. Each slip pin connector 18 comprises a slip pin 44 having an eye 46, as shown in FIG. 4, formed on one end thereof. The eye 46 has an inside diameter sufficient to receive a threaded bolt 38. The slip pins 44 are typically formed of cold rolled steel wire of #11 or #9 gage approximately 10 to 24 inches in length. The eye 46 of one slip pin 44 is mounted on each threaded bolt 38 on each support rod 14 and 16 and retained thereon by the wing-nut 42. The straight or free end 48 of each slip pin 44 is adapted to be slidably received to a greater or lesser extent in any of the channels 37 or 37' which are large enough in cross-section to accommodate the slip pins.

Figure 7:
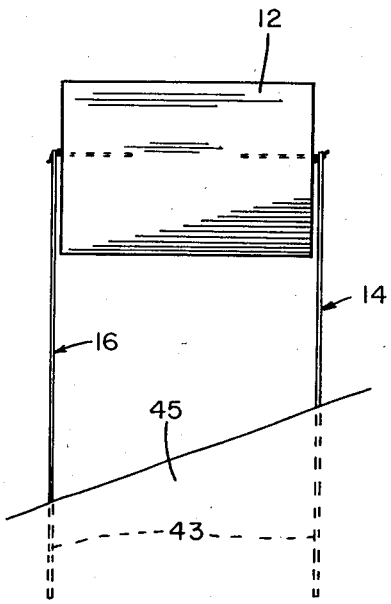

Assembly and erection of the subject sign holder in an outdoor environment according to the present invention is as follows. The lower ends 43 of a pair of vertical support rods 14 and 16 are inserted into a penetratable supporting surface such as into the ground to an extent necessary to maintain the rod and sign panel attached thereto in a vertical orientation. As shown in FIG. 7, the rods 14 and 16 may be inserted to different depths to accommodate installing the sign on a side hill location. Because the support rods 14 and 16 are of a relatively small diameter, the force required for insertion of the rods 14 and 16 into the ground is not great. The support rods 14 and 16 are transversely spaced a distance at least as great as the width of the vertical sign panel board to be erected but need not be precisely positioned by virtue of the inventive aspects of assembly of the present invention. The sign panel board 12 bearing the desired advertising or other indicia on one or both sides is generally positioned between the vertical support rods 14 and 16, approximately as shown in FIG. 1 but likewise need not be precisely oriented. The slip pin connectors 18 and 20 are inserted somewhere into the upper half of the panel 12 from the right and left side of the panel board 12 and into any of the channels 37 or 37' between the front and rear panel members 24 and 26 or 24' and 26'. Preferably the straight end 48 of each slip pin 44 is inserted in the same transversely extending channel 37, if pivotal swinging of the sign panel board 12 is desired. However, the slip pins 44 may be inserted in any desired and different channels 37, and inserted transversely to a greater or lesser extent depending upon the vertical and transverse positioning of the sign panel board 12 or 12' relative to each of the adjacent support rods 14 and 16. After the slip pins 44 are inserted from opposite directions into selected ones of the channels 37 to a greater or lesser extent depending upon the transverse distance between the rod 14 and the board 12, the eyes 46 of each slip pin 44 are mounted on one of the threaded members 40 and the wing-nuts 42 are threaded thereon to retain the slip pins 44 on the threaded members 40. If the slip pins 44 are inserted in the same channel 37, the vertical panel 12 is free to pivot or swing about a rotational axis defined by the slip pins 44 under the action of prevailing winds that otherwise might be problematical in an outdoor setting were the sign panel not allowed to such swing. Of course if some restriction or pivoting were desired then the slip pins 44 may be inserted into opposite ends of different channels 37. Because of ease of assembly, it is feasible and convenient to install sign holders according to the present invention in difficult side hill locations, such as suggested in FIG. 7. Additionally, because both the front and rear face surfaces 28 and 34 are adapted to receive indicia and because of ease in erection, it is feasible to install signs so that they may be read from both the front and the rear thereof.

It will be appreciated that in addition to ease in assembly, erection and disassembly, the present invention offers significant advantages in storage such as in an instance wherein a number of signs of the same or different sizes and holders therefor are to be stored and transported as in the trunk of a passenger automobile. In such an instance, a substantial number of like elements, such as vertical support rods, slip pins and wing-nuts may be purchased and stored in the same or in separate boxes or carried loosely in an auto trunk without substantial space requirements. Since all of the sign holder elements are relatively compact, lightweight, interchangeable and usable for different size sign boards, storage space requirements may be minimized.

Figure 5:
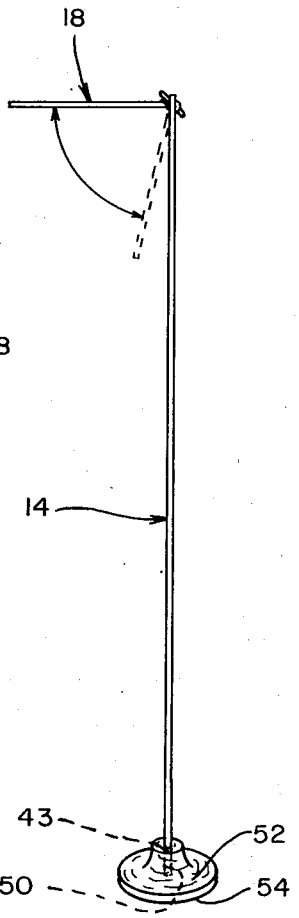
FIG. 5 is a front elevational view of a vertical support element of an alternate form of the present invention supported in a pedestal as for an indoor application supported on a floor.

In an alternative form of the present invention shown in FIG. 5, the bottom end 43 of each of the vertical support rods 14 and 16 is slidably and removably received in a cylindrical bore 50 of a weighted pedestal or base 52 having a flat lower surface 54. The flat surface 54 of the base 52 is adapted to rest on any horizontal surface, such as on the ground or on a floor when used in an indoor application. Two such bases 52 are required to support the two elements 14 and 16 in an upright position.

Figure 6A:
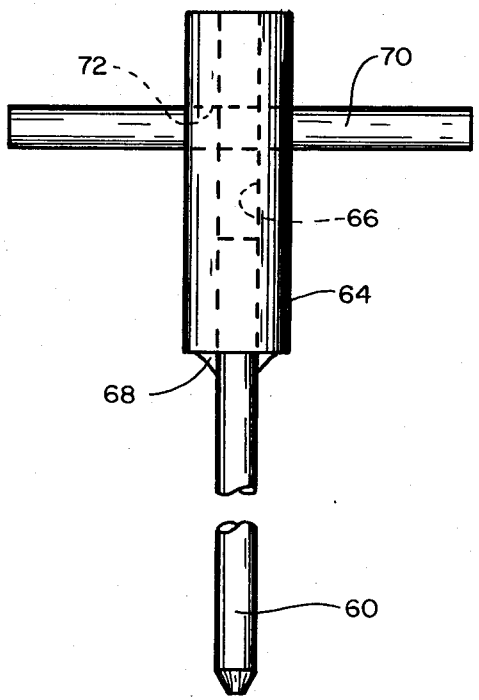
FIG. 6*a* is an enlarged elevational view partly in section showing more of the details of the device of FIG. 6; and, FIG. 7 is a front elevational view of a sign holder shown in FIG. 1 but shown installed on a side hill location.
Figure 6:
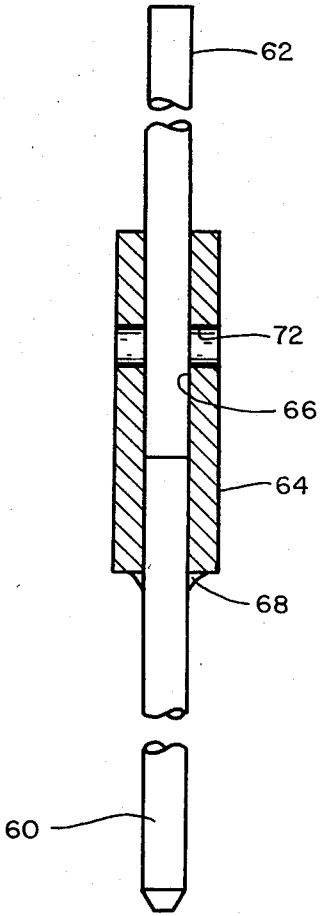
FIG. 6 is an elevational view of another alternate form of one of the vertical supports of the present invention.

A still further embodiment of the present invention is partially shown in FIG. 6. In this form, the vertical support members, one of which is partially shown in FIG. 6, are of a larger diameter and length, compared to the supports 14 and 16 of the embodiment shown in FIG. 1 to facilitate support of a larger sign panel than the embodiment shown in FIG. 1. In this embodiment, the vertical support member 14' is also preferably formed of cold rolled steel rod 5/16 inch or larger in diameter and may have a total length of up to about approximately 84 inches or longer. However, to facilitate storage of the elements of this embodiment, as in the trunk of a passenger automobile, as well as to facilitate insertion of the support member 14' in a supporting surface, the support member 14' is constructed of two sections, a lower section 60 and an upper section 62 each being about 42 inches in length. The two sections 60 and 62 are connected together in aligned condition using a steel sleeve member 64 which has a bore 66 therethrough. The sleeve 64 is welded or otherwise attached to the upper end of the lower section 60 as at 68. A typical sleeve 64 may be about 9 inches in length with the lower section extending into the lower end of the sleeve 64 about 3 inches leaving 6 inches for the upper section to extend downwardly into the sleeve bore 66 to abut the section 60. This provides good support for the upper section 62.

With the upper section 62 withdrawn from the sleeve 64 a shorter working rod or tool 70 of the same diameter as the sections 60 and 62 can be inserted into the upper sleeve bore portion and pounded on to drive the lower section 60 into the ground. This obviates the need to pound on the sleeve 64 and cause damage thereto. After the lower section 60 is driven into the ground the rod 70 can be removed from the bore 66 and replaced by the upper section 62. The opposite post can be installed in similar manner.

Later when it is desired to remove the posts from the ground, the tool 70 (or one of the sections 60 or 62) can be inserted through an optional cross bore 72 in the sleeve (FIG. 6*a*) and used to twist the lower sections 60 out of the ground.

Assembly and erection of the embodiment shown in FIGS. 6 and 6*a* is substantially the same as the assembly of the embodiment shown in FIG. 1 except that in the embodiment of FIG. 6 the lower section 60 of each of the vertical support members 14' is first inserted into the supporting surface by positioning tool 70 in the upper end of the sleeve 64 and striking on its upper end with any suitable driver the striking instrument. The remainder of the assembly procedure is the same as for the embodiment shown in FIG. 1. It should be appreciated that the various elements of the embodiments shown may be scaled up or down as desired.

While several embodiments of the present invention have been specifically disclosed, it will be apparent to those skilled in the art after a review of these descriptions that other changes, modifications, variations and other uses and applications for the subject invention, in addition to those which have been disclosed herein, are possible and contemplated. For example, different connector elements from those herein disclosed may be utilized while utilizing other aspects of the instant invention. All such changes, modifications, variations and other uses and applications which do not depart from the spirit and scope of the invention are deemed to be covered by the invention which is limited only by the claims which follow.

What is claimed is:

1. A sign holder comprising a panel adapted to receive indicia thereon for display purposes;

a pair of support elements supporting said panel, said support elements being adapted to be positioned on opposite sides of said panel permitting a variable distance between said support elements and permitting variable distances from each of said support elements to said panel; and connector means connecting said panel to each of said support elements permitting variable positions of said panel between said support elements.

2. The sign holder of claim 1 wherein said connector means includes a first connector means connected to each of said support means and a plurality of alternately usable second connector means connected to said panel, at least one of said second connector means cooperating with said first connector means to support said panel on said support means.

3. The sign holder of claim 2 wherein each of said first connector means includes an elongated member one end of which is removably connected to one of said support elements, and the other end of which projects toward said panel, and each of said second means comprising a channel having an inner cavity, at least one of said channel cavities removably slidably receiving said other ends of said elongated members.

4. The sign holder of claim 3 wherein said other end of said elongated member is inserted in said channel to a greater or lesser extend depending on the transverse distance from said panel to each of said support elements.

5. A sign holder comprising a vertical panel including spaced front and rear panel members, at least one of said panel members adapted to receive indicia thereon for display purposes, and a plurality of vertically spaced, transversely extending web members connected between said front and rear panel members, said plurality of web members with adjacent portions of said front and rear panel members defining a plurality of vertically spaced, transversely extending channels;

a pair of support elements for supporting said panel, one of said support elements positioned on each transverse side of said vertical panel; and a pair of pin members each having one end removably connected to respective ones of said support elements and an opposite end removably received in at least one of said channels of said panel.

6. The sign holder of claim 5 wherein each of said opposite ends of said pair of pin members are received in opposite ends of the same channel of said panel.

7. The sign holder of claim 6 wherein said one end of each of said pin members includes an eye slidably receiving a threaded member fixed adjacent the upper end of said vertical support elements, and a wing-nut threadably connected to said threaded member for fixing the connector pin eye to said threaded member.

8. The sign holder of claim 6 further including a pair of pedestal members each having a cavity therein for slidably receiving one end of one of the support elements for supporting the same on a support surface.

9. The sign holder of claim 5 wherein each of said support elements is formed of at least two sections and a sleeve member removably connecting said two sections together in aligned condition.

10. The sign holder of claim 9 wherein said sleeve member is fixedly connected to one of said two sections and forms a socket for receiving a portion of the other of said sections.

11. The sign holder of claim 10 wherein the sleeve member has a transversely extending bore therethrough and a rod member for positioning in the transverse bore bore used for rotating the section fixedly attached thereto.

12. A sign construction comprising a panel having height and width and spaced opposite side walls and means connecting the side walls including means forming at least one elongated open ended channel extending across the width of the panel between the side walls, a pair of elongated similar support members adapted to be supported in upright condition spaced apart at least equal to the width of the panel, means on each of said support members adjacent corresponding ends thereof for cooperating with the channel in the panel, each of said means including an elongated rod having a first end for connection to the support member and an opposite free end insertable into the channel.

13. The sign construction of claim 12 wherein each of the support members for a threaded member attached thereto and each of the elongated rods has an eyelet on the first end thereof for receiving the threaded member therethrough, and means threadedly engageable with the threaded member for locking the respective rod members to the support members.

14. The sign construction of claim 12 wherein each of the support members is rod shaped having one end for inserting into the ground.

15. The sign construction of claim 12 wherein the panel is a corrugated member having spaced opposite side walls and a corrugated member extending therebetween to define a plurality of parallel channels extending across the width thereof.

* * * * *